US011346535B2

(12) United States Patent
Chami et al.

(10) Patent No.: US 11,346,535 B2
(45) **Date of Patent: *May 31, 2022**

(54) ADJUSTABLE, MODULAR FLOOD LIGHT FIXTURE

(71) Applicant: MaxLite, Inc., West Caldwell, NJ (US)

(72) Inventors: Aymen Chami, Hackettstown, NJ (US); Eric Clohosey, Hawthorne, NJ (US)

(73) Assignee: MAXLITE, INC., West Caldwell, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/236,541

(22) Filed: Apr. 21, 2021

(65) Prior Publication Data

US 2021/0239305 A1 Aug. 5, 2021

Related U.S. Application Data

(63) Continuation of application No. 16/708,713, filed on Dec. 10, 2019, now Pat. No. 10,995,941.

(60) Provisional application No. 62/780,736, filed on Dec. 17, 2018.

(51) Int. Cl.

| | |
|---|---|
| ***F21V 21/30*** | (2006.01) |
| ***F21S 2/00*** | (2016.01) |
| ***F21V 29/76*** | (2015.01) |

(52) U.S. Cl.

CPC ..... *F21V 21/30* (2013.01); *F21S 2/005* (2013.01); *F21V 29/763* (2015.01)

(58) Field of Classification Search

CPC ..... F21V 21/30; F21S 2/005

See application file for complete search history.

(56) References Cited

U.S. PATENT DOCUMENTS

| | | | | |
|---|---|---|---|---|
| 3,210,531 | A | 10/1965 | Neely et al. | |
| 4,707,766 | A | 11/1987 | Bertozzi et al. | |
| 7,121,688 | B2 | 10/2006 | Rempel | |
| 7,207,696 | B1 * | 4/2007 | Lin | F21V 14/02 362/232 |
| 7,431,482 | B1 | 10/2008 | Morgan et al. | |
| 7,712,926 | B2 | 5/2010 | Matheson | |
| 8,858,028 | B2 | 10/2014 | Kim | |
| 8,888,335 | B2 | 11/2014 | Wang | |
| 9,618,172 | B1 | 4/2017 | Means | |
| 9,651,232 | B1 * | 5/2017 | Fletcher | F21V 21/26 |
| 2006/0146550 | A1 | 7/2006 | Simpson et al. | |
| 2008/0089071 | A1 | 4/2008 | Wang | |
| 2009/0109670 | A1 | 4/2009 | Boyer | |
| 2009/0135602 | A1 | 5/2009 | Liu et al. | |

(Continued)

FOREIGN PATENT DOCUMENTS

| | | | |
|---|---|---|---|
| EP | 2267356 | A1 | 12/2010 |

*Primary Examiner* — Alexander K Garlen

(74) *Attorney, Agent, or Firm* — Budzyn IP Law, LLC

(57) ABSTRACT

An adjustable, modular flood light fixture is provided herein which includes a plurality of light modules, each including an enclosure and a luminaire configured to generate light, the luminaire being pivotably mounted to the enclosure. The light modules are serially connected with the luminaires of the light modules being each independently, pivotably adjustable. Advantageously, with the subject invention, the size of an illuminated area may be controlled by the number of light modules being used, with pivoting adjustment allowing further control over how light from each of the light modules is directed.

13 Claims, 3 Drawing Sheets

(56) References Cited

U.S. PATENT DOCUMENTS

| | | | | |
|---|---|---|---|---|
| 2009/0141494 | A1 | 6/2009 | Zhang et al. | |
| 2009/0168422 | A1 | 7/2009 | Chiu et al. | |
| 2011/0133670 | A1 | 6/2011 | Lee et al. | |
| 2011/0317435 | A1* | 12/2011 | Wang | F21V 21/025 362/370 |
| 2012/0127713 | A1 | 5/2012 | Lee | |
| 2012/0140473 | A1* | 6/2012 | Chang | F21V 21/30 362/249.03 |
| 2013/0148340 | A1 | 6/2013 | Shen | |
| 2013/0223069 | A1* | 8/2013 | Kim | F21K 9/60 362/243 |
| 2015/0211720 | A1 | 7/2015 | Toner | |
| 2015/0354794 | A1 | 12/2015 | Guercio et al. | |
| 2016/0265756 | A1 | 9/2016 | Silver et al. | |
| 2016/0320006 | A1* | 11/2016 | Ip | F21S 2/00 |
| 2017/0241633 | A1 | 8/2017 | Shoji | |
| 2017/0370537 | A1 | 12/2017 | Wu et al. | |

* cited by examiner 28
24
12
26
14
20
34
18
22
64
66
58
62
68
51
35
60
37
60
58
36
35
51
32
51
70
72
59
66
64
40
48
56
72
38
50
44

42
43
16
46
54
52

ADJUSTABLE, MODULAR FLOOD LIGHT FIXTURE

CROSS-REFERENCE TO RELATED APPLICATION

This application is a continuation of U.S. patent application Ser. No. 16/708,713, filed Dec. 10, 2019, now U.S. Pat. No. 10,995,941, which claims priority to U.S. Provisional Patent Appl. No. 62/780,736, filed Dec. 17, 2018, the contents of which are incorporated by reference herein.

BACKGROUND OF THE INVENTION

Flood light fixtures are known in the prior art for lighting large areas, such as parking lots, fields, etc. The size and shape of the generated light pattern may be of concern, particularly if private homes are near the illuminated area. Generated light may inadvertently shine into private homes if not properly controlled.

SUMMARY OF THE INVENTION

An adjustable, modular flood light fixture is provided herein which includes a plurality of light modules, each including an enclosure and a luminaire configured to generate light, the luminaire being pivotably mounted to the enclosure. The light modules are serially connected with the luminaires of the light modules being each independently, pivotably adjustable. Advantageously, with the subject invention, the size of an illuminated area may be controlled by the number of light modules being used, with pivoting adjustment allowing further control over how light from each of the light modules is directed.

These and other features of the subject invention will be better understood through a study of the following detailed description and accompanying drawings.

DETAILED DESCRIPTION OF THE INVENTION

Figure 1:
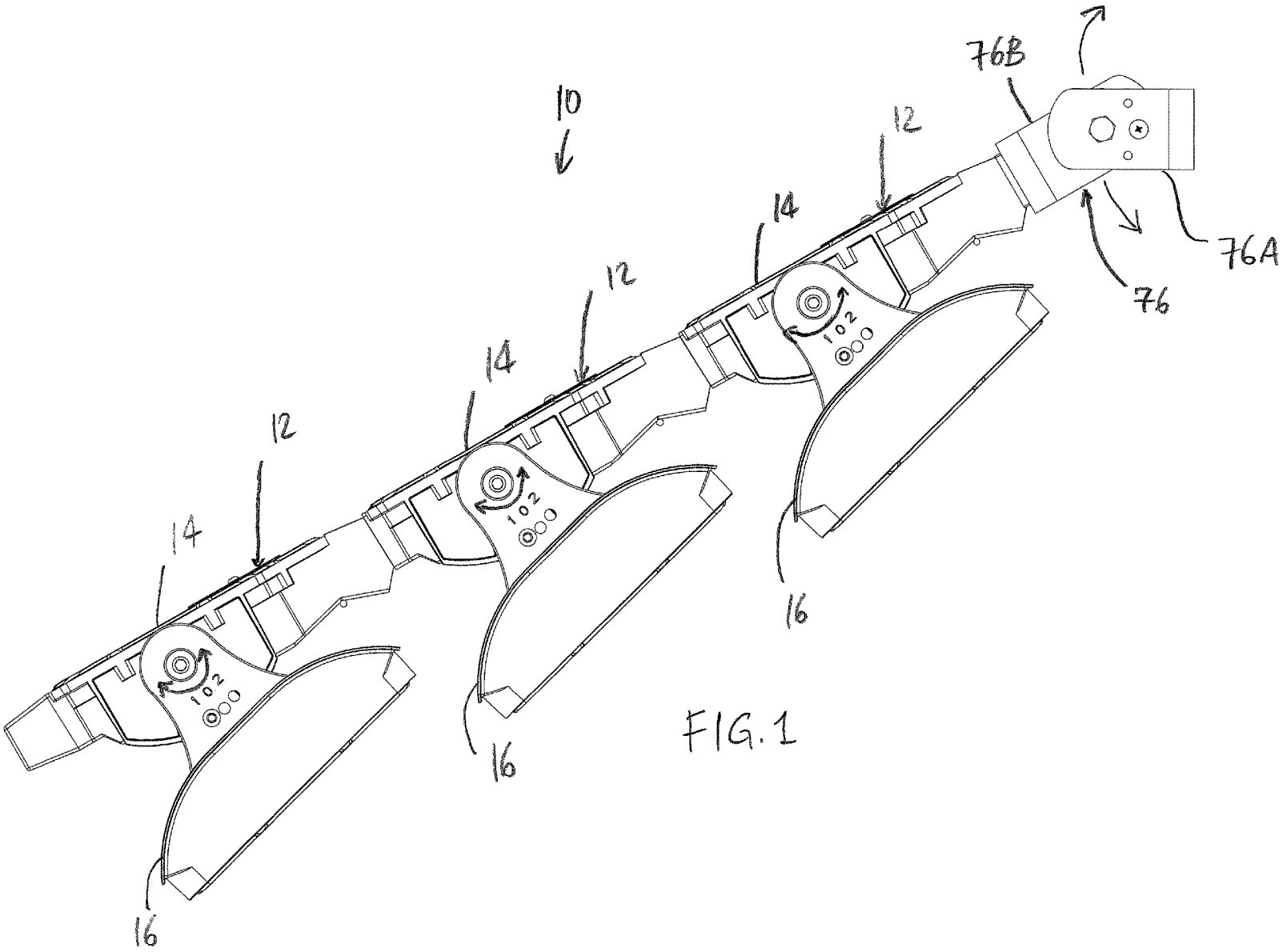
FIG. 1 shows an adjustable, modular flood light fixture formed in accordance with the subject invention.

With reference to FIG. 1, an adjustable, modular flood light fixture 10 is shown. The light fixture 10 is composed of a plurality of light modules 12. As will be appreciated by those skilled in the art, any number of the light modules 12 may be utilized with the subject invention.

Figure 2:
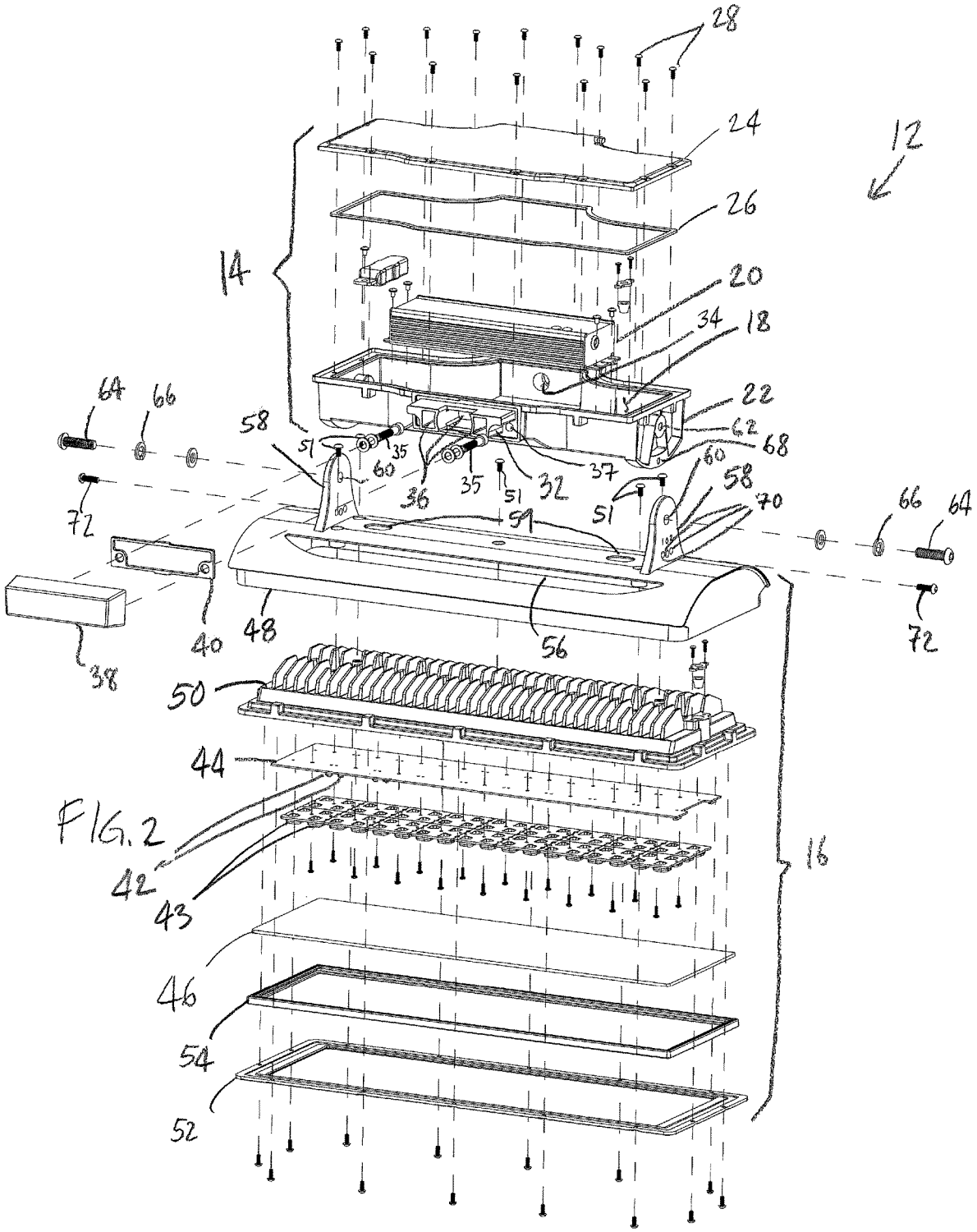
FIG. 2 is an exploded view of a light module useable with the subject invention.

Preferably, each of the light modules 12 is similarly formed so that a single design may be replicated in minimizing the number of pieces needed in inventory. With reference to FIG. 2, each of the light modules 12 includes an enclosure 14 and a luminaire 16. The luminaire 16 is pivotally mounted to the enclosure 14.

The enclosure 14 defines an enclosed volume 18 for housing power supply related components and electronics needed to power and control the corresponding luminaire 16. As shown in FIG. 2, for example, a driver 20 may be housed within the enclosed volume 18. The enclosure 14 may be provided in multiple components such as a housing 22 with a removable access panel 24 which allows access into the enclosed volume 18. To allow for outdoor use, it is preferred that the enclosure 14 be formed from weather-resistant materials (e.g., aluminum), and be provided with seals or gaskets at any interfaces, such as gasket 26 to seal the interface between the housing 22 and the access panel 24. The enclosure 14 also needs to be of sufficiently robust construction to support the luminaire 16 and adjacent light module(s) 12. The access panel 24 may be secured to the housing 22 using any type of technique, such as removable fasteners 28, e.g., screws.

Figure 4:
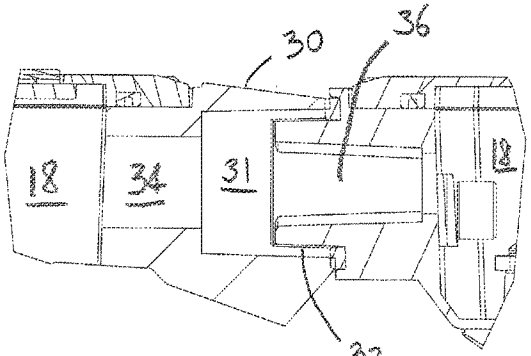

The light modules 12 are serially connected to form the light fixture 10. Preferably, the light modules 12 are serially connected at the enclosures 14, i.e., with the enclosures 14 being directly connected one to another. To provide for direct connection of the enclosures 14, by way of non-limiting example, the enclosure 14 may include a protruding mounting collar 30 and a corresponding mounting block 32 formed on an opposing side of the enclosure 14. As shown in FIG. 4, the mounting block 32 is configured to be inserted into open channel 31 of the mounting collar 30 of an adjacent light module 12 in telescoping fashion in forming a connection between two of the light modules 12.

Passageway 34 is formed to extend from the open channel 31 of the mounting collar 30 into communication with the enclosed volume 18. One or more channels 36 are formed to extend through the mounting block 32 also into communication with the enclosed volume 18. The passageway 34 allows for power supply wiring to be provided into the enclosed volume 18 with the channels 36 allowing power supply wiring to be extended out of the enclosed volume 18 and into the next adjacent light module 12. The ultimate light module 12 of the light fixture 10 will have the mounting block 32 exposed, since no further light modules 12 are mounted thereto. To restrict the ingress of moisture into the enclosed volume 18 of the ultimate light module 12, cap 38 may be provided formed to cover the channels 36 of the mounting block 32. Gasket 40 may be provided to seal the interface between the cap 38 and the mounting block 32 in enhancing the resistance against ingress of moisture into the channels 36.

Each of the luminaires 16 is configured to generate light. The luminaires 16 may each include a plurality of solid state lighting elements 42, such as, light emitting diodes (LEDs), organic light emitting diodes (OLEDs), and, polymer light emitting diodes (PLEDs). The solid state lighting elements 42 may be mounted to a board 44 in any known manner. Optics 43 may be provided for the solid state lighting elements 42 with the optics 43 being mounted to the board 44 to cover the solid state lighting elements 42 as is known in the art. The optics 43 may be used to direct the generated light of the solid state lighting elements 42.

A lens or diffuser 46 may be provided for the luminaire 16 located so that light generated by the solid state lighting elements 42 passes therethrough (having passed through the optics 43 if utilized). Luminaire housing 48 is provided with sufficient volume to enclose components of the luminaire 16. One or more heat dissipation blocks 50 may be provided particularly above the board 44 and the solid state lighting elements 42 so as to draw heat away therefrom. Frame 52 may be provided to secure the lens or diffuser 46 to the heat dissipation block 50. Frame gasket 54 may be provided to seal the interface between the frame 52 to the lens or diffuser 46 and the heat dissipation block 50. The lens or diffuser 46 may be mounted to the heat dissipation block 50 using the frame 52 with this sub-assembly being mounted to the luminaire housing 48 as one piece, e.g., using fasteners 51. One or more vent holes 56 may be provided in the luminaire housing 48 to enhance heat dissipation.

The luminaire 16 is pivotally mounted to the enclosure 14 using any known arrangement. By way of non-limiting example, upstanding brackets 58 may be provided on the luminaire housing 48 having formed therethrough pivot holes 60. Corresponding enclosure pivot holes 62 are formed on the enclosure 14 positioned to align with the pivot holes 60. Pivot pins or fasteners 64 are provided which pass through the pivot holes 60 to be seated in the enclosure pivot holes 62 to allow for pivoting of the luminaire 16 relative to the enclosure 14 about the pivot pins or fasteners 64. As shown in FIG. 2, with the use of pivot fasteners 64, locking washers 66 (e.g., split washers) may be provided to minimize unwanted reverse loosening from the enclosure pivot holes 62.

It is preferred that the upstanding brackets 58 have sufficient length to provide sufficient clearance between the enclosure 14 and the luminaire housing 48 to allow for a range of pivoting motion. In addition, knock-outs 59 may be provided on the enclosure 14 and the luminaire 16 for allowing wiring to pass therebetween. Any wiring between the enclosure and the luminaire 16 must have sufficient slack to accommodate pivoting movement of the luminaire 16 relative to the enclosure 14. The luminaire 16 receives power and control signals, as is known in the art, from the enclosure 14.

Various arrangements may be provided to allow for releasable locking of the luminaire 16 in a particular angular position relative to the enclosure 14. In one manner, tightening of the pivot fasteners 64 may provide for releasable locking. In addition, or alternatively, locking apertures 68 may be provided on the enclosure 14 selectively alignable with one or more positioning apertures 70 formed on the upstanding brackets 58. Locking pins or fasteners 72 may be provided to pass-through target positioning apertures 70 in fixing a luminaire 16 at a particular angular position relative to the enclosure 14.

Figure 3:
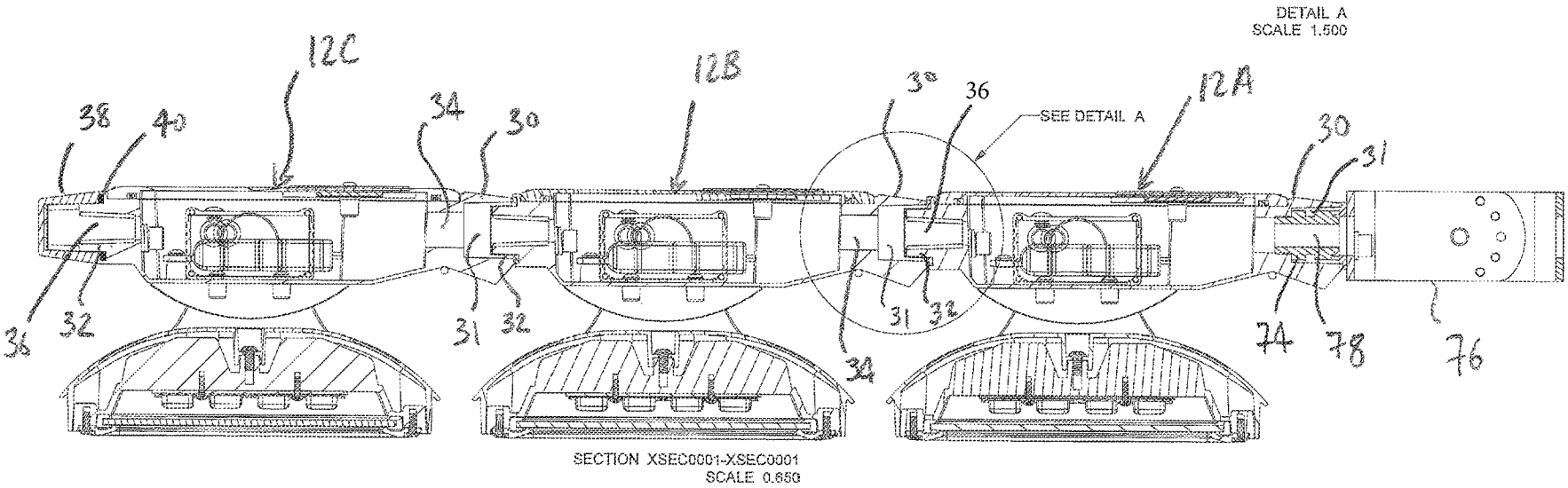
FIG. 3 is a cross-sectional view of the flood light fixture of FIG. 1; and, FIG. 4 is an enlarged view of Detail A of FIG. 3.

With reference to FIG. 3, a plurality of the light modules 12A, 12B, 12C may be serially connected to form the light fixture 10. As will be understood by those skilled in the art, although three of the light modules 12 are shown in FIGS. 1 and 3, various quantities of the light modules 12 may be utilized. The light modules 12A, 12B, 12C are serially connected by inserting the mounting block 32 of one of the light modules 12 into the mounting collar 30 of the adjacent light module 12. Thus, for example, the mounting block 32 of the light module 12A is received in the mounting collar 30 of the light module 12B while the mounting block 32 of the light module 12B is received in the mounting collar 30 of the light module 12C. To support the light fixture 10, the mounting collar 30 of the first light module 12A receives fixture mounting collar 74 of a mounting 76 used to support the light fixture 10. Access passageway 78 is formed through the fixture mounting collar 74 to be in communication with the interior of the mounting collar 30 of the first light module 12A. This allows for power supply wires to enter into the light fixture 10. The interconnections of the mounting collars 30 and the mounting blocks 32 allow for power to be carried between the light modules 12 via the passageways 34 and the channels 36. As discussed above, the mounting block 32 of the ultimate light module 12C is preferably sealed off by the cap 38 to limit the ingress of moisture into the channels 36. Screws or other fasteners 35 may be utilized to enhance securement between the interconnected mounting collars 30 and mounting blocks 32. The fasteners 35 may be configured to extend between the enclosed volumes 18 of the interconnected light modules 12, passing through connection passageways 37 formed in the enclosures 14. In addition, seals or gaskets may be utilized at interfaces to limit ingress of moisture into the light modules 12.

The quantity of the light modules 12 useable with the light fixture 10 may be limited by the inherent weight of the light fixture 10. With serial connection, the entire weight of the light fixture 10 is suspended through the mounting 76. The interconnection between the first light module 12A and the mounting 76 may limit the number of the light modules 12 that may be secured to the first light module 12A.

As shown in FIG. 1, it is preferred that the mounting 76 be pivotable with stationary mounting portion 76A for fixed mounting to a support structure and angularly adjustable portion 76B pivotably mounted to the stationary mounting portion 76 A. This allows for the overall pivoting of the light fixture 10. In addition, for each of the light modules 12, the luminaire 16 is pivotable, thus allowing for independent adjustment of each of the luminaires 16. The light fixture 10 advantageously allows for the size of a light field to be configured depending on the quantity of the number of the light modules 12 being used, as well as the overall angular adjustment of the light fixture 10 about the mounting 76 with further possible adjustment of each of the luminaires 16.

What is claimed is:

1. An adjustable, modular light flood light fixture comprising:

a plurality of light modules, each of the light modules including:

a rectangular enclosure having first and second longitudinal sides and first and second ends, wherein the first and second longitudinal sides extend between, and are longer than, the first and second ends; and, a luminaire pivotably mounted to the first and second ends of the enclosure, wherein, the light modules are serially connected, along a longitudinal axis, with direct connections between the first and second longitudinal sides of the enclosures of adjacent light modules, and, with the luminaires of the light modules being each independently, pivotably adjustable, and, wherein, the serially-connected light modules are secured to a pivotable mounting coaxially aligned with the longitudinal axis.

2. The flood light fixture as in claim 1, wherein, for each of the light modules, the luminaire is separate from the enclosure.

3. The flood light fixture as in claim 1, wherein, for each of the light modules, a power supply for the luminaire is provided in the enclosure.

4. The flood light fixture as in claim 1, wherein one or more channels pass through the connections between the light modules.

5. The flood light fixture as in claim 1, wherein, for each of the light modules, a releasable lock is provided to releasably lock the luminaire in an angular position relative to the enclosure.

6. The flood light fixture as in claim 5, wherein the releasable lock includes alignable apertures in the luminaire and the enclosure formed to receive a locking pin.

7. The flood light fixture as in claim 1, wherein, for each of the light modules, the luminaire includes a plurality of solid state lighting elements.

8. The flood light fixture as in claim 7, wherein the plurality of solid state lighting elements are mounted to one or more boards.

9. The flood light fixture as in claim 8, wherein one or more heat dissipation blocks are located above the one or more boards.

10. The flood light fixture as in claim 9, wherein the plurality solid state lighting elements, the one or more boards, and the one or more heat dissipation blocks are enclosed within the luminaire.

11. The flood light fixture as in claim 1, wherein, for each of the light modules, upstanding brackets are provided on the luminaire which are pivotably connected to the first and second ends of the enclosure to pivotably mount the luminaire to the first and second ends of the enclosure.

12. The flood light fixture as in claim 11, wherein each of the upstanding brackets includes a pivot hole through which passes a pivot pin or fastener which is fixed to the enclosure.

13. The flood light fixture as in claim 11, wherein the upstanding brackets are formed with sufficient length to provide sufficient clearance between the luminaire and the enclosure to allow pivoting of the luminaire relative to the enclosure.

* * * * *